US009664393B2

(12) United States Patent
Andersson et al.

(10) Patent No.: US 9,664,393 B2
(45) Date of Patent: May 30, 2017

(54) BURNER OF GAS TURBINE WITH FUEL NOZZLES TO INJECT FUEL

(71) Applicant: Siemens Aktiengesellschaft, Munich (DE)

(72) Inventors: Mats Andersson, Norrkoping (SE); Alessio Bonaldo, Norrkoping (SE)

(73) Assignee: Siemens Aktiengesellschaft, Munich (DE)

( * ) Notice: Subject to any disclaimer, the term of this patent is extended or adjusted under 35 U.S.C. 154(b) by 257 days.

(21) Appl. No.: 14/390,783

(22) PCT Filed: Apr. 8, 2013

(86) PCT No.: PCT/EP2013/057273
§ 371 (c)(1),
(2) Date: Oct. 5, 2014

(87) PCT Pub. No.: WO2013/153013
PCT Pub. Date: Oct. 17, 2013

(65) Prior Publication Data

US 2015/0082796 A1 Mar. 26, 2015

(30) Foreign Application Priority Data

Apr. 10, 2012 (EP) ..... 12163593

(51) Int. Cl.
*F23R 3/36* (2006.01)
*F23R 3/14* (2006.01)
(Continued)

(52) U.S. Cl.
CPC ..... *F23R 3/36* (2013.01); *F23D 17/002* (2013.01); *F23R 3/14* (2013.01); *F23R 3/286* (2013.01); *F23R 3/34* (2013.01)

(58) Field of Classification Search
CPC .... F23R 3/36; F23R 3/14; F23R 3/286; F23R 3/34; F23D 17/002
(Continued)

(56) References Cited

U.S. PATENT DOCUMENTS 3,283,502 A * 11/1966 Lefebvre ..... F23R 3/14 60/739
5,954,495 A * 9/1999 Knopfel ..... F23C 7/002 431/284
(Continued)

FOREIGN PATENT DOCUMENTS

CN 1185561 A 6/1998
CN 1316198 C 5/2007
(Continued)

*Primary Examiner* — Steven Sutherland
(74) *Attorney, Agent, or Firm* — Breusse Wolter Sanks & Maire

(57) ABSTRACT

A burner of a gas turbine extending along an axis is provided having in axial order: a swirler section, mixing section, outlet section, and main combustion zone. The swirler section has swirler vanes to swirl a stream of fuel and oxygen containing gas entering therein in a circumferential direction. The mixing section conducts the premix of fuel and oxygen containing gas to the outlet section. The outlet section discharges the premix into the combustion zone expanding the flow of premix from a smaller axial cross section of the mixing section to a larger cross section of the combustion zone which streamlines the flow to diverge radially. A surface of the outlet section facing the flow of the premix is provided with first fuel nozzles injecting fuel into the premix into a radial inwardly inclined direction before the flow of the premix enters the outlet section into the combustion zone.

15 Claims, 3 Drawing Sheets

(51) Int. Cl.

| | |
|---|---|
| ***F23R 3/28*** | (2006.01) |
| ***F23D 17/00*** | (2006.01) |
| ***F23R 3/34*** | (2006.01) |

(58) Field of Classification Search
USPC ..... 60/737, 746, 748
See application file for complete search history.

(56) References Cited

U.S. PATENT DOCUMENTS

| | | | | |
|---|---|---|---|---|
| 6,045,351 | A | 4/2000 | Steinbach | |
| 6,102,692 | A * | 8/2000 | Dobbeling | F23C 7/002 239/402 |
| 6,126,439 | A | 10/2000 | Knopfel et al. | |
| 6,152,726 | A | 11/2000 | Knopfel | |
| 6,186,775 | B1 * | 2/2001 | Jansohn | F23C 7/002 431/258 |
| 6,189,314 | B1 | 2/2001 | Yamamoto et al. | |
| 6,331,109 | B1 * | 12/2001 | Paikert | F23C 7/002 431/350 |
| 7,140,183 | B2 * | 11/2006 | Ruck | F23R 3/343 60/737 |
| 2005/0164138 | A1 | 7/2005 | Ruck et al. | |
| 2007/0259296 | A1 | 11/2007 | Knoepfel | |
| 2012/0036855 | A1 | 2/2012 | Brodin et al. | |

FOREIGN PATENT DOCUMENTS

| | | | |
|---|---|---|---|
| CN | 101243287 | A | 8/2008 |
| CN | 102007341 | A | 4/2011 |

* cited by examiner

BURNER OF GAS TURBINE WITH FUEL NOZZLES TO INJECT FUEL

CROSS REFERENCE TO RELATED APPLICATIONS

This application is the U.S. National Stage of International Application No. PCT/EP2013/057273 filed Apr. 8, 2013, and claims the benefit thereof. The International Application claims the benefit of European Application No. EP12163593 filed Apr. 10, 2012. All of the applications are incorporated by reference herein in their entirety.

FIELD OF INVENTION

The invention relates to a burner of a gas turbine extending along an axis and comprising in axial order: —a swirler section, —a mixing section, —an outlet section, —a main combustion zone and —wherein said swirler section comprises swirler vanes made to swirl a stream of fuel and oxygen containing gas entering the swirler section in a circumferential direction, —wherein said mixing section conducts the premix of fuel and oxygen containing gas to said outlet section, —wherein said outlet section discharges said premix into said combustion zone expanding the flow of premix from a smaller axial cross section of said mixing section to a larger cross section of said combustion zone, which expansion makes streamlines of said flow to diverge radially.

BACKGROUND OF INVENTION

In the field of gas turbine burners flame stabilization at the burner outlet is of high importance to obtain low emission and low combustion dynamics phenomena which can damage the combustor hardware. Usually the flow of fuel is delivered through injection nozzles within the burner system and combustion is achieved in the combustion chamber containing a combustion zone. A combustor of that kind is described in patent U.S. Pat. No. 6,152,726 (filing date 28 Nov. 2000). The known burner uses several injection channels for fuel supply. Currently gaseous fuel is used e.g. natural gas. A first fuel supply, which is used to inject the main portion of fuel is located in the swirler section, wherein nozzles are provided at the edges of the main swirler vanes. The secondary fuel supply may be located at a central lance, which extends coaxially with the main axis of the burner. This second fuel supply is optional and preferably used to fix the flame front at a specific location and to avoid high frequency fluctuations. A third fuel supply is used to ignite and maintain the flame front in the main combustion zone and located at the end of said outlet section, which comprises an annular rim protruding into said combustion zone, wherein said rim is provided with second fuel nozzles discharging fuel in a radial outward direction.

The known burner achieves low emission because most of the fuel is delivered at the swirler vane region which is capable to homogenously distribute the fuel in the airstream respectively to guarantee a good premix. Said central gas injection improves flame stability in a limited range of operation because at higher central gas flow rates the flame position moves an increases combustor dynamics. The third way to inject fuel by said external pilot nozzles improves stability by a diffusive type flame but increases also emissions which also limits the range of operation. At full load conditions the emissions need to be low and therefore the external pilot is fed by only a minor portion of fuel which leads to a smaller pilot flame region which is less effective in stabilizing the main flame. Especially in the outlet section of the burner between the main combustion zone and said rim of the outlet section the flow is highly turbulent while a shear layer develops between a high flow speed and regions of decreased flow speed. This shear layer develops between the diffusive flame type of the external pilot and the main combustion zone which reduces the stabilizing effect of the external pilot located at the outer rim of said outlet section for the main combustion zone flame front. To avoid the flame front of the main combustion zone to be extinguished the fuel flow of the external pilot has to be increased which results in higher NOX emissions. This effect is further versant by injection of air through mixing tube cooling air holes which reduces the fuel concentration on the shear layer further. To compensate this effect respectively to stabilize the combustion the fuel supply to the external pilot must be further increased which does not only increase NOX emissions but also lead to temperatures at the external rim of said outlet section which are not acceptable with regards to material properties of said outlet section.

SUMMARY OF INVENTION

It is one object of the invention to increase stability of combustion in the described burner type.

It is another object of the invention to enable a wider operation range of the described burner type.

It is still another object of the invention to decrease emissions—especially NOX emissions—of the described burner type.

Is it still another object of the invention to enable a higher flexibility with regard to the fuel to be combusted.

It is still another object of the invention to improve the burner efficiency of the incipiently described burner type.

To solve at least one of the above objects the invention proposes a burner of the incipiently mentioned type comprising the additional features as claimed. The dependent claims respectively relate to additional embodiments of the invention respectively inventive improvements.

A burner is often also referred to as a combustor. Said swirler vanes are designed to increase a circumferential velocity component which leads to a better mixing of fuel and air especially in said mixing section. Said mixing section may be a cylindrical shaped cavity enclosed by an outer shell. The surface of said outer shell may have perforated sections to inject air respectively oxygen containing gas. Said oxygen containing gas is injected in the mixing zone to on the one hand increase the oxygen content of the premix and on the other hand to cool the shell of the mixing section. The cooling film of the air injected prevents the shell to be destroyed by the heat impact from the combustion zone.

The outlet section is basically a continuation of the cylindrical shell of the mixing section without perforations for cooling air injection. The downstream end of the outlet section preferably comprises a slight enlargement of the axial cross section of said shell to decrease any turbulence of the flow of the premix entering the combustion zone. Further said outlet section may comprise an annular rim protruding into said combustion zone and being located at a downstream end of said outlet section. The outer surface of said annular rim may be provided with second fuel nozzles discharging fuel in an inclined direction between an axial direction and a strictly radial outward direction. The discharged fuel basically forms a conus diverging in axial downstream direction.

Preferably the burner comprises a central lance extending co-axially in a downstream direction, wherein a downstream tip of said lance is provided with fuel injection nozzles for both gas and oil.

BRIEF DESCRIPTION OF THE DRAWINGS

The above mentioned attributes and other features and advantages of this invention and the manner of attaining them will become more apparent and the invention itself will be better understood by reference to the following description of the currently best mode of carrying out the invention taken in conjunction with the accompanying drawings, wherein.

DETAILED DESCRIPTION OF INVENTION

Figure 1:
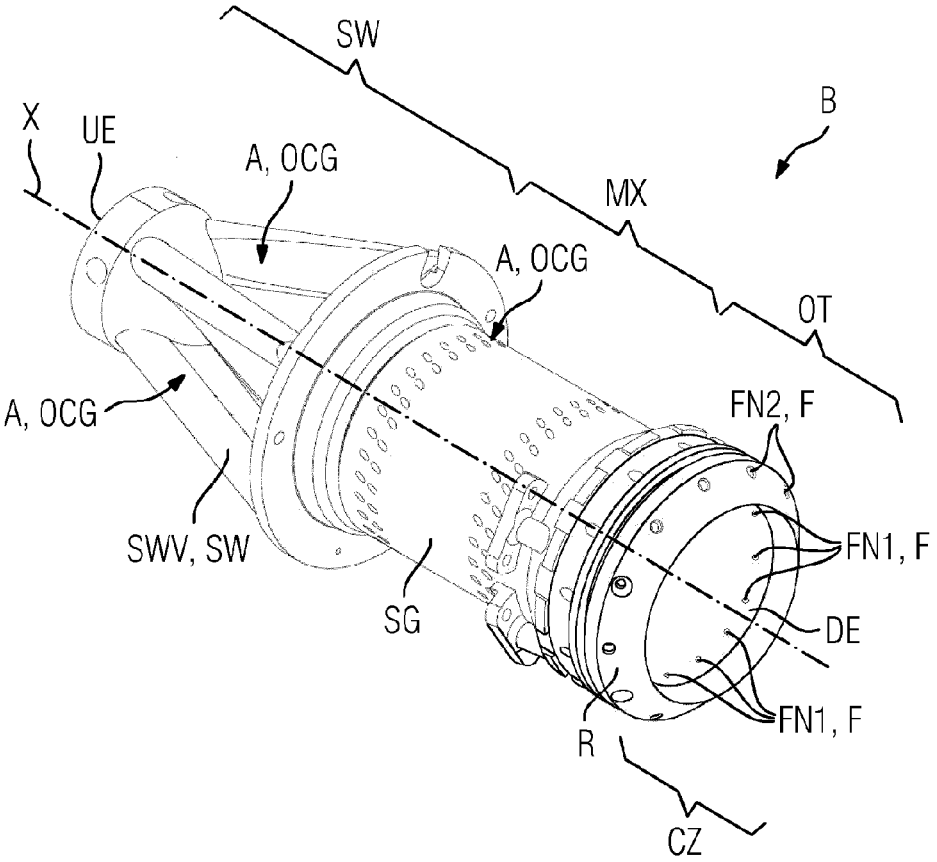
FIG. 1 shows a three dimensional depiction of a burner according to the invention.
Figure 2:
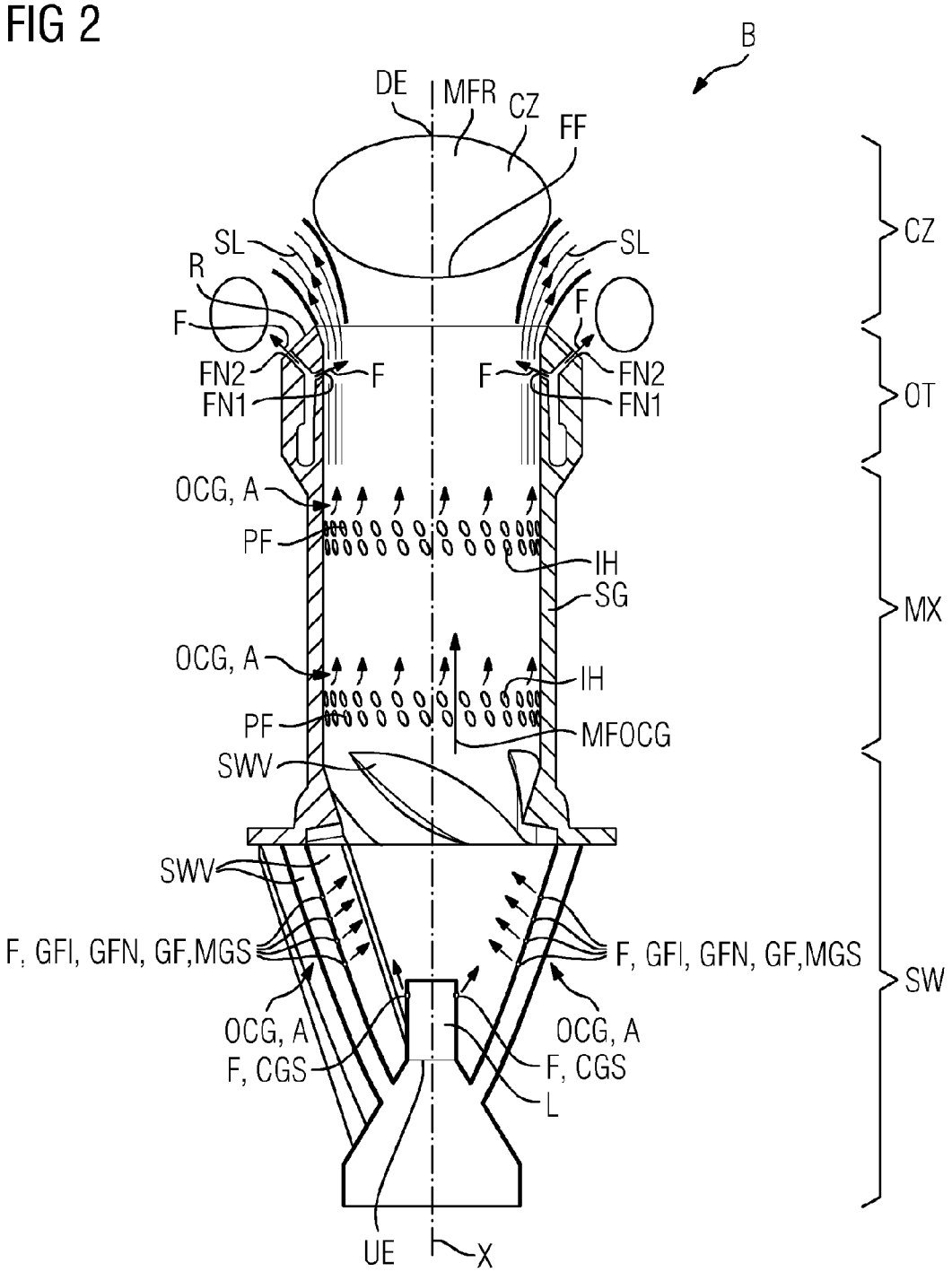
FIG. 2 shows a longitudinal cross section along an axis X through a burner according to the invention.

FIGS. 1 and 2 shows a burner B of a gas turbine according to aspects of the invention in a schematic three-dimensional depiction respectively in a longitudinal cross section along a central axis X. Said burner B can be divided along an axial sequence from an upstream end UE to a downstream end DE with regard to the flow of an oxygen containing gas OCG—hereinafter referred to as air A—and the flow of fuel F—gaseous or liquid fuel—a swirler section SW, a mixing section MX, an outlet section OT and a main combustion zone CZ.

Said swirler section SW comprises swirler vanes SWV. Leading edges of said swirler vanes SWV can be seen in the three-dimensional depiction of FIG. 1. FIG. 2 shows schematically the geometry of said swirler vanes SWV and there extension inside said swirler section SW. A main gas supply MGS as well as a central gas supply CGS are part of said swirler section. Said main gas supply MGS supplies a main portion of said fuel F, wherein a flow of fuel F enters channels defined by said swirler vanes SWV from a more radial direction and is deflected into said axial direction. Said central gas supply CGS is designed like a lance extending coaxially in axial direction. At a downstream end of said lance L nozzles for fuel injection are provided injecting fuel F in an inclined direction between the axial direction and a radial outward direction. Said swirler vanes SWV imprint a circumferential velocity component on the flow to improve mixing of fuel and air in the downstream mixing section MX.

Said mixing section MX is defined by a cylindrical shaped shell SG conducting the fuel from said swirler section SW downstream to said outlet section subsequently into said combustion zone CZ. An inner surface of said cylindrical shell SG comprises perforated sections PF for injecting air. The injected air establishes a film covering the inner surface of said shell SG laminary. The injected air A mixes with said fuel F from said swirler section SW resulting in a premix MFOCG of oxygen containing gas OCG and fuel F. Downstream said mixing section MX said premix MFOCG enters said outlet section OT. Said outlet section OT is a cylindrical continuation of said mixing section MX. The inner surface of said outlet section OT is provided with first fuel nozzles FN1 injecting fuel F into said premix MFOCG. Said first fuel nozzles FN1 inject fuel in an inclined direction between a radial inward direction and said axial direction. Generally the direction of injection of said first fuel nozzles can be slightly downstream. The fuel F injected by said first fuel nozzles FN1 enrich said film air A with fuel F before said premix and film air is discharged into said combustion zone CZ . A main flame region MFR of said combustion zone CZ is located with its center on said axis X. A shear layer SL forms between said main flame region MFR of said combustion zone CZ and the downstream end of said outlet section OT. Said downstream end of said outlet section OT protrudes as a rim R into said main combustion zone CZ. An outer surface of said rim R is provided with external pilot fuel nozzles respectively second fuel nozzles FN2 discharging fuel F in a radial outward direction. Said radial outward direction is downstream inclined between said axial direction and said radial outward direction. At said second fuel nozzles FN2 a diffusion type flame establishes stabilizing a flame front FF in the main flame region MFR. Between said pilot flames and said main flame region MFR said shear layer SL established is mainly composed of the flow of said air A respectively film air FA from said mixing section MX and said outlet section OT. Since said film air FA is enriched from fuel F discharged by said first fuel nozzles FN1 a flame ignition of said main flame region MFR by said pilot flames is improved.

Figure 3:
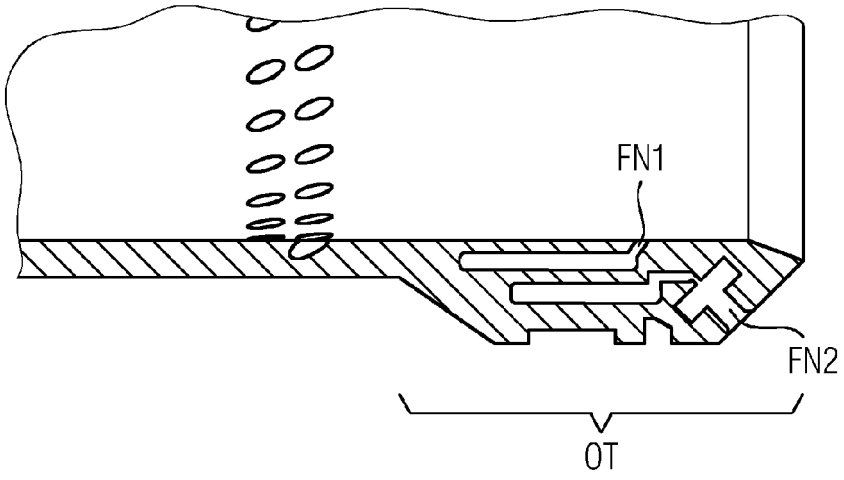
FIG. 3 shows a detail of a first embodiment of the outlet section according to detail III of FIG. 2
Figure 4:
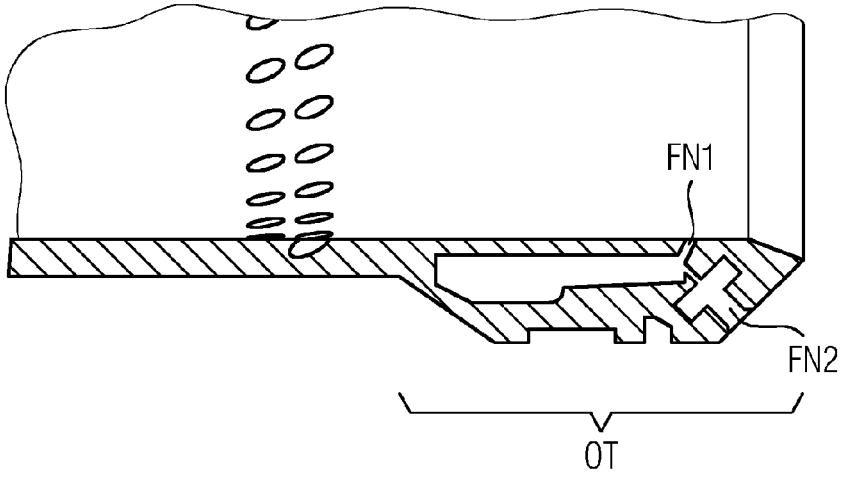
FIG. 4 shows a detail of the outlet section according to detail IV of FIG. 2.

FIGS. 3 and 4 show respective geometries of inner channels provided in the shell SG of said outlet section OT.

In the embodiment of FIG. 3 separate channels are provided for said inner wall injection points and said external pilot injectors, a first fuel channel CHF1 for said first fuel nozzle FN1 respectively an inner wall injection point and a second fuel channel for said fuel nozzle FN2 respectively an external pilot injector.

In the embodiment of FIG. 4 one mutual channel for said first fuel nozzle FN1 respectively said inner wall injection point respectively said first nozzle FN1 and said second fuel nozzle FN2 respectively said external pilot injector.

The invention claimed is:

1. A burner (B) of a gas turbine extending along an axis (X) and comprising in axial order:

a swirler section (SW), a mixing section (MX), an outlet section (OT), and a main combustion zone (CZ), wherein said swirler section (SW) comprises swirler vanes (SWV) made to swirl a stream of fuel (F) and oxygen containing gas (OCG) entering the swirler section (SW) in a circumferential direction, wherein said mixing section (MX) is configured to conduct a premix (MFOCG) of the fuel (F) and oxygen containing gas (OCG) to said outlet section (OT), wherein said outlet section (OT) is configured to discharge said premix (MFOCG) into said main combustion zone (CZ) expanding a flow of premix (MFOCG) from a smaller axial cross section of said mixing section (MX) to a larger cross section of said main combustion zone (CZ) which makes streamlines of said flow to diverge radially, wherein a surface of the outlet section (OT) facing the flow of said premix (MFOCG) is provided with first fuel nozzles (FN1) configured to inject fuel into said premix (MFOCG) in a radial inwardly inclined direction before the flow of said premix (MFOCG) enters said outlet section (OT) into said main combustion zone (CZ), wherein said outlet section (OT) comprises an annular rim (R) protruding into said main combustion zone (CZ) comprising second fuel nozzles (FN2) configured to discharge fuel (F) in a radial outward direction, and wherein the outlet section (OT) further comprises one mutual channel for the first fuel nozzles (FN1) and the second fuel nozzles (FN2).

2. The burner (B) according to claim 1, wherein said mixing section (MX) comprises inlet holes (IH) for injecting oxygen containing gas (OCG), and wherein said inlet holes (IH) are made to provide a film of oxygen containing gas (OCG) along an inner surface of said mixing section (MX).

3. The burner (B) according to claim 2, wherein the first fuel nozzles (FN1) are further configured to inject the fuel into the film of oxygen containing gas (OCG) along the inner surface of said mixing section (MX) before the main combustion zone (MCZ).

4. The burner (B) according to claim 1, wherein said swirler section (SW) comprises a central gas supply (CGS) made to inject liquid fuel (F).

5. The burner (B) according to claim 1, wherein said swirler section (SW) comprises a gas fuel injection (GFI) comprising gas fuel injection nozzles (GFN) for injecting gaseous fuel (GF) as part of said swirler vanes (SWV).

6. The burner (B) according to claim 1, wherein said mixing section (MX) has a cylindrical shape extending coaxially along said axis (X).

7. The burner (B) according to claim 1, wherein the second fuel nozzles (FN2) are configured to discharge fuel to form a conus diverging in the radial outward direction.

8. A method for operating the burner (B) of claim 1, comprising:

providing the stream of fuel (F) and oxygen containing gas (OCG) to the swirler section;

swirling the stream of fuel (F) and oxygen containing gas (OCG) in the swirler section;

conducting the premix (MFOCG) of the fuel (F) and oxygen containing gas (OCG) to the outlet section (OT);

discharging the premix (MFOCG) into the main combustion zone (CZ) with the outlet section (OT) including expanding the flow of premix (MFOCG) from the smaller axial cross section of said mixing section (MX) to the larger cross section of said main combustion zone (CZ);

injecting fuel into the premix (MFOCG) in the radial inwardly inclined direction with the first fuel nozzles (FN1) before the flow of the premix (MFOCG) enters the main combustion section (CZ); and discharging fuel into the main combustion zone (CZ) in the radial outward direction with the second fuel nozzles (FN2).

9. The method of claim 8, further comprising:

injecting oxygen containing gas (OCG) through inlet holes (IH) in said mixing section (MX); and providing a film of oxygen containing gas (OCG) along an inner surface of said mixing section (MX) based on the injecting the oxygen containing gas (OCG).

10. The method of claim 9, further comprising injecting fuel into the film of oxygen containing gas (OCG) with the first fuel nozzles (FN1) before said film is discharged into the main combustion zone (CZ).

11. The method of claim 8, further comprising:

establishing a diffusion type flame at the second fuel nozzles (FN2) based on the discharging fuel into the main combustion zone (CZ); and stabilizing a flame front (FF) in a main flame region (MFR) of the main combustion zone (CZ) located along the axis (X) based on the diffusion type flame.

12. A burner (B) of a gas turbine extending along an axis (X) and comprising in axial order:

a swirler section (SW), a mixing section (MX), an outlet section (OT), and a main combustion zone (CZ), wherein said swirler section (SW) is configured to swirl a stream of fuel (F) and oxygen containing gas (OCG) entering the swirler section (SW) in a circumferential direction, wherein said mixing section (MX) is configured to conduct a premix (MFOCG) of the fuel (F) and oxygen containing gas (OCG) to said outlet section (OT), wherein said outlet section (OT) is configured to discharge a flow of said premix (MFOCG) into said main combustion zone (CZ);

wherein a surface of the outlet section (OT) facing the flow of said premix (MFOCG) is provided with first fuel nozzles (FN1) configured to inject fuel into said premix (MFOCG) in a radial inwardly inclined direction before the flow of said premix (MFOCG) enters said outlet section (OT) into said main combustion zone (CZ), wherein said outlet section (OT) comprises an annular rim (R) protruding into said main combustion zone (CZ) comprising second fuel nozzles (FN2) configured to discharge fuel (F) in a radial outward direction, and wherein the outlet section (OT) further comprises one mutual channel for the first fuel nozzles (FN1) and the second fuel nozzles (FN2).

13. The burner (B) according to claim 12, wherein the second fuel nozzles (FN2) are configured to discharge fuel to form a conus diverging in the radial outward direction.

14. The burner (B) according to claim 12, wherein said mixing section (MX) comprises inlet holes (IH) for injecting oxygen containing gas (OCG), and wherein said inlet holes (IH) are made to provide a film of oxygen containing gas (OCG) along an inner surface of said mixing section (MX).

15. The burner (B) according to claim 14, wherein the first fuel nozzles (FN1) are further configured to inject the fuel into the film of oxygen containing gas (OCG) along the inner surface of said mixing section (MX) before the main combustion zone (CZ).

* * * * *